US008900168B2

(12) United States Patent
Yamashiro et al.

(10) Patent No.: US 8,900,168 B2
(45) Date of Patent: Dec. 2, 2014

(54) BODY SURFACE COMPRESSION WITH PNEUMATIC SHORTENING ELEMENT

(76) Inventors: Stanley M. Yamashiro, Anaheim, CA (US); Patsy K. Yamashiro, Anaheim, CA (US)

( * ) Notice: Subject to any disclaimer, the term of this patent is extended or adjusted under 35 U.S.C. 154(b) by 1203 days.

(21) Appl. No.: 12/416,869

(22) Filed: Apr. 1, 2009

(65) Prior Publication Data

US 2010/0256540 A1 Oct. 7, 2010

(51) Int. Cl.

| | |
|---|---|
| ***A61H 31/00*** | (2006.01) |
| ***A61H 11/02*** | (2006.01) |
| ***A61H 11/00*** | (2006.01) |
| ***A61H 9/00*** | (2006.01) |

(52) U.S. Cl.

CPC ..... *A61H 11/00* (2013.01); *A61H 9/0078* (2013.01); *A61H 31/006* (2013.01); *A61H 2011/005* (2013.01); *A61H 2201/165* (2013.01); *A61H 2201/5056* (2013.01)

USPC ..... 601/44; 601/41; 601/151; 601/152

(58) Field of Classification Search

CPC ..... A61H 9/005; A61H 9/0078; A61H 31/00; A61H 31/004; A61H 31/006; A61H 31/007; A61H 31/008; A61H 2031/003; A61H 2011/005; A61H 2201/0103; A61H 2201/1238; A61H 2201/1619; A61H 11/02; Y10S 601/06; Y10S 601/07

USPC ..... 601/41, 43, 84–85, 133–134, 44, 88, 601/96, 105–106, 148–153; 128/846–847

See application file for complete search history.

(56) References Cited

U.S. PATENT DOCUMENTS

| | | | | |
|---|---|---|---|---|
| 2,071,215 | A * | 2/1937 | Petersen | 601/41 |
| 2,844,126 | A | 7/1958 | Gaylord | |
| 3,364,924 | A | 1/1968 | Barkalow | |
| 4,396,010 | A | 8/1983 | Arkans | |
| 4,928,674 | A | 5/1990 | Halperin | |
| 5,190,036 | A | 3/1993 | Linder | |
| 5,467,766 | A | 11/1995 | Ansite | |
| D461,008 | S | 7/2002 | Hampf | |
| 6,616,620 | B2 | 9/2003 | Sherman | |
| 7,096,866 | B2 | 8/2006 | Be'eri | |
| 7,226,427 | B2 | 6/2007 | Steen | |
| 2005/0011518 | A1 * | 1/2005 | Biondo et al. | 128/204.18 |
| 2005/0126578 | A1 * | 6/2005 | Garrison et al. | 128/874 |
| 2006/0009717 | A1 * | 1/2006 | Hall et al. | 601/41 |

OTHER PUBLICATIONS

Chou and Hannaford, "Measurement and Modeling of McKibben Pneumatic Artificial Muscles", IEEE Trans on Robotics and Automation, vol. 12, pp. 90-102, 1996, USA.

* cited by examiner

*Primary Examiner* — Justine Yu
*Assistant Examiner* — Michael Tsai

(57) ABSTRACT

A body surface compression device for generating cyclical or constant compressions for medical purposes. Compression is accomplished using pneumatic actuated artificial muscle in combination with a belt placed around a body part. Both artificial muscle shortening and pneumatic expansion are used for compression. A unique useful property of this system is the length-tension characteristic similar to natural muscle which reduces applied compressive force proportionally with the level of volume compression of the body part. This property as well as a uniformly applied compression over the body part allows compression to be accomplished in a way which resembles natural muscle activation and minimizes overall abnormal stress on the body part.

15 Claims, 8 Drawing Sheets

BODY SURFACE COMPRESSION WITH PNEUMATIC SHORTENING ELEMENT

CROSS-REFERENCE TO RELATED PUBLICATIONS

No prior related applications.

FEDERALLY SPONSORED RESEARCH AND DEVELOPMENT

No federally supported research and development involved.

REFERENCE TO COMPACT DISC

No compact disc referenced or submitted.

FIELD OF ENDEAVOR

The field of endeavor concerns devices for application of externally applied pressure or compression to a body surface for medical purposes.

BACKGROUND OF THE INVENTION

Devices for compression of the mammalian chest and/or abdomen or application of externally applied pressures to a body surface have been used extensively on patients for many medical purposes. The most common example is in cardiopulmonary resuscitation (CPR). For manually applied CPR in human adults a mid-sternal chest compression of 1½ to 2 inches at a rate of 100 per minute is recommended by the American Heart Association. For a normal adult chest elasticity this requires a force of approximately 100 lbs. A common complication attributed to this high force is rib or sternum fracture. Prior studies on accidental injury have reported that chest deflections as little as 2.3 inches have resulted in rib fracture (J. Cavanaugh, In: Accidental Injury Biomechanics and Prevention, 2$^{nd}$ edition, Eds. A. Nahum and J. Melvin, 2001, Springer-Verlag, pg 377). It is also well known that the elderly are more prone to fractures. Manual CPR involves applying the entire force through the palm of one hand. This is a similar force application to automated CPR machines such as the Thumper (Barkalow, U.S. Pat. No. 3,364,924) or Lucas (Hampf, U.S. Pat. No. D461,008, Steen, U.S. Pat. No. 7,226,427) systems. Another automated CPR system called the AutoPulse (Sherman, U.S. Pat. No. 6,616,620) applies the force through a pad pulled over the anterior surface of the chest via motorized belts. These automated systems are all in common use. Halperin et al. (Halperin, U.S. Pat. No. 4,928,674) described an automated inflatable cuff surrounding the anterior and lateral surfaces of the chest which then resulted in what they considered was a uniform circumferential compression. This resulted in less rib compression required for a given volume or intrathoracic pressure change. These investigators were then able to apply considerably higher total force for the same chest deflection. One reason for this improvement was the constraint set by the posterior wall of the thorax since it is fixed by the spine and is not involved in chest volume change. Thus, any applied force limited to the anterior chest surface as in Manual CPR, Thumper, Lucas or AutoPulse leads to bulging of the unconstrained lateral chest surfaces (and loss of compression) which is prevented by uniform circumferential compression. Uniform compression also avoids stress concentrations such as is obvious near the sternum with manual CPR or Thumper or Lucas and at the borders of the anterior and lateral surfaces when a pad is used over the anterior surface. Such stress concentrations increase the likelihood of fractures. Despite stress advantages, the cuff system requires a cumbersome pneumatic system which is impractical for portable emergency use. This limitation is due to the large bladder size (volume) required to surround the chest and the need to rapidly inflate and deflate this bladder up to 100 times a minute. Also, a cuff system applies a constant pressure during compression unlike a volume reduction due to natural muscle which reduces force as volume decreases because of the length-tension property of muscle. Natural muscle applies maximum force initially at resting length and reduces force as it shortens even with a constantly maintained stimulation. At close to 50% shortening of the initial resting length net muscle force decreases to zero. This means that a cuff imposed compression will result in a higher mechanical stress compared to what is possible with natural muscle.

Alternating compression and decompression of the thorax and/or abdomen is an old idea credited to R. Eisenmenger (Wien Klin Wochenschr 42: 1502-3, 1929) which has recent device manifestations. Both active and passive decompression has been tried. Merely binding or applying a constant pressure over the abdomen during chest CPR has also been found to be advantageous (Lottes et al. Resusitation: 75: 515-24, 2007). Cyclical compression of the abdomen alone has also been tried in animals and found to lead to improved indices of coronary blood flow (Geddes et al. Am. J. Emerg. Med. 25: 786-790, 2007). A limitation of any form of abdominal compression is the possible consequences of a full stomach during compression for CPR purposes. A mouthward movement of stomach contents could compromise application of assisted ventilation which is usually simultaneously required.

Another motivation for manipulating externally applied pressures is to assist cough or relieve choking. The most well known example is the Heimlich maneuver which uses manually applied abdominal pressure to dislodge food from the airway. Application of a relatively high vacuum at the mouth (machine exsufflation) for short durations following a large inspiration (machine insufflation) is a cough assist technique developed in the 1950s for the polio epidemic and has recently been brought back for patient use (Be'eri, U.S. Pat. No. 7,096,866). Airflow levels lower than normal cough results with this method. This technique requires application of large positive and negative pressures at the mouth (up to + or −45 cm H2O) which is not well tolerated by all patients. Bach, who has been a primary force in re-emergence of this technique, (Chest 126: 1388-1390, 2004) has recommended that: " . . . we have always found it extremely important to institute abdominal thrusts during the exsufflation cycling of the machine to maximize cough flows." The abdominal thrusts refer to manually applied compressions which could also be applied by an assistive device. Simultaneous compression of the chest and abdomen along with voluntary closure followed by sudden opening of the glottis is a possible assist method to use on a repeated basis which is much closer to normal cough than the machine in-exsufflator. Such compression can also be used in combination with manipulation of mouth, mask, or tracheal pressure using the in-exsufflator machine to further enhance cough airflow. The in-exsufflator machine is apparently only well tolerated by 90% of patients (Miske et al. Chest 125: 1406-1412, 2004) so alternative assist devices are needed as well. Electrical stimulation of abdominal muscles has been tried for cough assist (Linder, U.S. Pat. No. 5,190,036), but the level of airflow does not match a normal cough. In addition, direct electrical stimulation of muscle has the added complication of pain fiber stimulation which limits the magnitude of tolerable assist. Cough assist is important to patients with spinal cord injuries who lack chest muscle control or elderly people too weak to cough effectively.

The Valsalva maneuver is a common voluntary practice where contraction of the abdominal muscles while closing the glottis is used to increase intra-abdominal pressure and aid peristalsis in propelling stool during defecation or bladder emptying. Spinal cord injuries are the most common cause of problems associated with bowel movement or bladder emptying. Constipation, digestive tract disease, and age are other examples where abdominal muscle function may be inadequate. Any assist to the abdominal muscles such as discussed above for cough can also be used for this purpose. Similar to cough this is most effectively done with participation by the subject in synchronizing assist with glottic aperture closure. The cardiovascular response to the Valsalva maneuver is different for normals and patients with heart failure (Felker et al. Am J. Med. 119: 117-122, 2006). This difference has been applied as a basis for using the Valsalva maneuver as a diagnostic test of cardiovascular function. The Valsalva maneuver using a facemask and valve applied during expiration has also been proposed as an aid for pressure equilibration at altitude (Ansite, U.S. Pat. No. 5,467,766). No assistive chest or abdominal compression was used for this device.

All prior methods applied for chest compression are very different than the normal physiological manner of reducing chest volume during expiration which involve shortening of muscle fibers between adjacent ribs. The external intercostal muscles run obliquely (downward and forward) from each rib to the rib below and attach to the outer surface of the ribs. The internal intercostal muscles attach to the inner surface of the ribs and run at right angles to the external intercostals. Coordinated contraction of internal and external intercostal muscles will lead to chest compression or expansion by drawing certain ribs together and being constrained by the structural arrangement of the ribs. Since all rib pairs have these muscles volume changes are accomplished very evenly and without stress concentration. Application of force by muscle is always accompanied by shortening of muscle fibers according to the length-tension and force-velocity properties of muscle. Skeletal muscle has a unique length-tension property such that maximum tension is produced at lengths near the normal resting length and any shortening leads to a decrease in tension. A shortening of about 50% of the resting length will lead to zero tension. Such properties are matched by the mechanical properties of the ribs to lead to the normal absence of rib fractures during physiological chest compression. There is a type of artificial muscle known in the prior art as the McKibben muscle (Gaylord, U.S. Pat. No. 2,844,126) which has a remarkable similarity to this action of muscle including intercostal muscles. The McKibben muscle is pneumatically actuated by inflating a bladder. The special property is that inflating a bladder leads to shortening of the muscle unit. This is accomplished by placing the bladder within a expandable braided cylindrical mesh made with flexible but inextensible fibers set at an acute angle (about 28 degrees unexpanded) with respect to the long axis of the muscle unit. Fibers are braided in a biaxial braid sometimes referred to as "Chinese finger trap" braid. A commonly used fiber material is nylon. This angle increases to about 54 degrees (C. Chou and B. Hannaford IEEE Trans on Robotics and Automation 12: 90-102, 1996) at maximum expansion (maximum shortening) when the net muscle force along the muscle length is zero due to the constraint set by the inextensible fiber. This type of braided sleeving is used extensively in the electronics industry because of this ability of expanding or contracting around different sizes. The length-tension relationship of this artificial muscle has been found to be linear and very similar to natural muscle (Gordon et al. J. Biomechanics 39: 1832-1841, 2006). This leads to a decrease in total applied force as the actuator shortens and resultant decrease in mechanical stress on supporting structures. A nylon sleeved artificial muscle with an unexpanded length of 23 inches and fiber angle of 28 degrees will shorten to 15 inches (35% of relaxed length) when inflated to a maximum fiber angle of 54 degrees. A maximally shortened artificial muscle force decreases to zero just like natural muscle. A cylindrical shaped muscle would have a diameter of 0.75 inch unexpanded and about 1.25 inch for maximum expansion. Natural muscle force-velocity properties diminish force at high shortening velocities. This action is not similar to McKibben muscle, but can easily be mimicked by adding a mechanical damper in parallel to the actuator (C. Chou and B. Hannaford IEEE Trans Robotics and Automation 12: 90-102, 1996) or by the simpler procedure of using an orifice (pneumatic resistance) to control the rate of bladder inflation. These procedures are well known to those skilled in the art. Thus, the McKibben muscle can be and has been applied as an artificial muscle substitute with similar length-tension and force-velocity properties to natural muscle. There has been no prior use of the McKibben muscle to compress the thorax or abdomen or other body part. All prior applications of artificial muscle has been connected to limb motion or a non-medical mechanical shortening application. No prior use of the McKibben muscle has used the pressure generated by the bladder itself for any purpose other than shortening of the muscle unit.

Cyclical compression of the lower extremities (Arkans, U.S. Pat. No. 4,396,010) has long been used for preventing pooling of blood in patients with impaired circulatory condition (deep vein thrombosis). This involves the application of pressure to a cuff or bladder analogous to the Halpern et al. (Halpern, U.S. Pat. No. 4,928,674) device used for CPR except cuffs are inflated over a portion or completely around the body part. Typically, the foot, calf, and thigh or the arms are the body parts compressed. The intent of such devices is to simulate compression of the limb veins by muscle and take advantage of valves located in large veins to direct flow back to the heart. A major limitation of current devices used for long term repeated cuff compression is due to surface trauma which leads to surface ulcers in patients (Oakley et al. BMJ 316:454-455, 1998). In this case cuff compression was limited to the sole of the foot at a pressure level of 80-130 mm Hg for 1 second every 20 seconds. The repeated chafing due to uneven compression was the most likely cause of foot ulcers. While uneven compression might be avoided with circumferential cuff compression, the high pressure levels required can still be a cause of ulcers. Even recently developed devices (e.g. Barak et al., U.S. Pat. No. 6,494,852) involve cuff compression which differs from the far gentler compressive action of normal muscle contraction. Cuff compression applies a pressure and resultant force which is held constant no matter how much volume reduction is achieved. A relatively high pressure is typically selected in order to promote a high peak velocity of blood returning to the heart. The level of pressure is then much higher than what is needed for expelling most of the blood volume from the limb. For example, a pressure of 3 kPa (22.5 mm Hg) on the calf leads to about 80 ml of blood volume expelled with very little additional volume expelled for higher pressures (Thirsk et al. Med. And Biol. Eng. and Comput. 18: 650-656, 1980) So applying 80-130 mm Hg achieves a high peak velocity at the expense of surface stress which should be avoided. This limitation is proposed as a key factor in explaining poor tolerance by patients when cuff compression is applied for extended periods. Various methods of compression such as intermittent or sequential or amount of tissue compressed (calf versus thigh) have been proposed as improvements, but at present there is no evidence to support the superiority of one method over another (Proctor et al. J Vasc Surg 34: 459-64, 2001.) Sequential compression involves compression in a sequential order from the extremity of the limb toward the torso. Thus, the main problem with prior art remaining to be addressed is surface trauma.

BRIEF SUMMARY OF THE INVENTION

This invention applies a pneumatically operated actuator commonly referred to as a McKibben artificial muscle to a new previously untried application to compressing the chest and/or abdomen and/or other body part for medical purposes. To accomplish this, the McKibben artificial muscle is positioned over the body part to be compressed using an inextensible but collapsible adjustable belt fastened to the artificial muscle and placed around the body part with only the belt positioned over the body part not to be compressed. For example, for conventional CPR the artificial muscle is fastened to the belt over the anterior and lateral surfaces of the thorax and only the belt is placed over the posterior thoracic surface. Application of gas pressure to the artificial muscle (pneumatic pressurization) leads to shortening (tightening of the belt placed over the posterior thoracic surface) and increase in pressure exerted by the artificial muscle on the body part (directly compressing the body part). The passive artificial muscle and belt then corresponds to a snugly fitted constraint around the body part such as the thorax. Pneumatic actuation leads to inflation of the artificial muscle and shortening or reduction of the constraint according to the applied pressure. Removal of the applied pressure or an applied vacuum will restore the original snug fitting condition and allow elastic recovery of the body part (relaxing of the belt placed over the posterior thoracic surface). The belt section positioned over the body part not to be compressed repeatedly subjected to tightening and loosening. References made to a belt which follows refers to this section unless otherwise stated, since a belt is not strictly needed for the portion of the body over which the artificial muscle is attached. This is because the artificial muscle itself can withstand tension in the relaxed state and any belt segment fastened mechanically in parallel with the artificial muscle is selected so it will collapse when pressurization and artificial muscle shortening occurs. The unique feature of this invention is the simultaneous use of applied pressure and shortening of artificial muscle to compress the body part which is promoted by using the artificial muscle in combination with a belt placed around the body part. The important advantage of this arrangement is the diminishing of belt tension due to artificial muscle shortening even as compression increases. In this way force on a body part is diminished in proportion to the level of compression automatically without the use of sensors or a control process. Compression then occurs in a manner closer to contraction of natural muscle. This action of artificial muscle is very different from the prior art using belts where belt tension always increases as compression increases. The overall effect at the extremes resembles a dynamic transition from a belt compression system to an inflatable cuff system, combining features of both systems. A rapid deployment like a belt system can be initially promoted due to maximum force application at the resting (relaxed) length and can transition to a cuff type compression with even circumferentially applied compression as maximal shortening and zero actuator tension is achieved. Depending on the level of compression, it is possible to operate on one or the other extreme or both. The preferred embodiment would be to operate at less than maximum shortening within the range of where the relationship between artificial muscle length and tension is essentially linear and most resembles normal muscle length-tension property. Rather than attachment using only a belt, the McKibben artificial muscle could also be connected to a relatively fixed surface like a backboard which a body part is placed on to accomplish the same purpose.

DETAILED DESCRIPTION OF THE INVENTION

Figure 1:
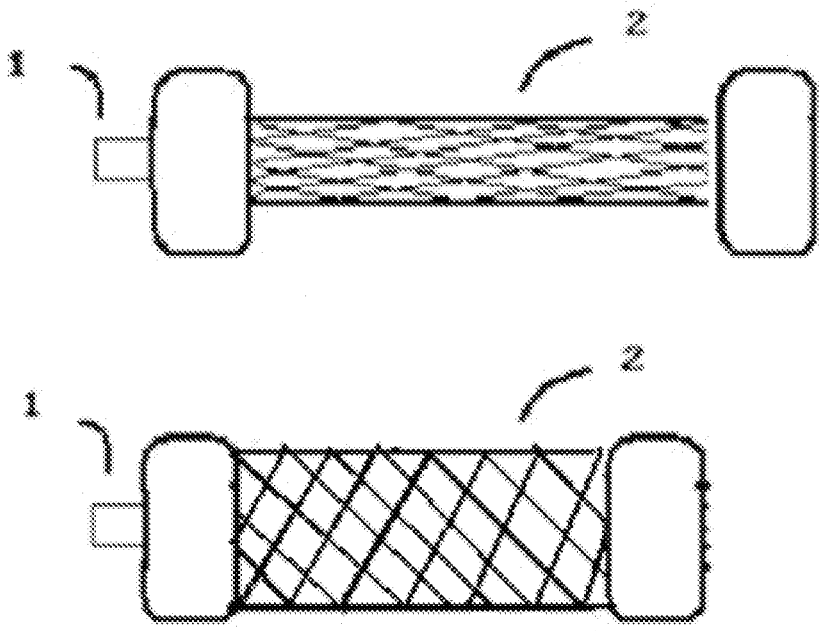
FIG. 1. McKibben muscle compared during pressurization and depressurization.

The present disclosure provides a solution to the problem of compressing the chest or abdomen or body part of a subject for medical purposes in a manner which minimizes the risk of rib fractures or other mechanical stress concentration complications. Cardiopulmonary resuscitation or CPR is the most common application of this procedure. The fundamental premise is that the closer compression of a body part is to the normal physiological manner, the more likely that complications can be avoided. Compression of any body part is accomplished by muscle and in the case of the chest it is the intercostals muscles which are forms of skeletal muscle. Intercostal muscles are arranged between ribs at an angle which is approximately opposing for the internal and external intercostals. Contraction of either types will evenly move ribs closer according to well defined length-tension and force-velocity properties. Even with similar chest volume changes as reported during CPR rib fracture does not normally occur because of the very even nature of rib compression via the intercostals muscles. The key to solving the problem of complications is then to mimic the action of the intercostal muscles. The McKibben artificial muscle) is used to provide the pneumatic artificial muscle means for shortening and resultant tightening of a belt placed around a body part. Details on design and construction are structurally as specified in the prior art (Chou. and Hannaford, "Measurement and Modeling of McKibben Pneumatic Artificial Muscles," IEEE Trans on Robotics and Automation, vol 12, pp 90-102, 1996). This artificial muscle is pneumatically actuated by inflating a bladder placed within an expandable braided cylindrical mesh or sleeve made with flexible but inextensible fibers. Fibers are braided in a biaxial braid sometimes referred to as "Chinese finger trap" braid. A commonly used fiber material is nylon and such sleeves are readily available in many different diameters to hold electrical cables together because of the ability of expanding or contracting around different sizes of cables. Different fiber materials and thicknesses can be used to promote durability or enhance performance. When unexpanded the fibers are at an angle of about 28 degrees which increases to about 54 degrees a t maximum expansion. The braided sleeve is what converts an increase in bladder pressure to a net "shortening" defined as a length change of the artificial muscle from one end to the other. Artificial muscle force F can be related to fiber angle θ, sleeve cross sectional area A (at θ=90 degrees) and pressure P as $$F=PA(3\cos^2(\theta)-1)$$

Note that the maximum force occurs at θ=0 and Fmax=2PA, F is near 0 at θ=54 degrees and 1.34*PA at θ=28 degrees. This equation is used for selecting the pressure and sleeve diameter required for different applications. The artificial muscle length L and diameter D are also a function of fiber angle θ as:

$$L=b\cos(\theta)$$

$$D=b\sin(\theta)/(n\pi)$$

where b=total length of each fiber from end to end and n=number of turns of each fiber from end to end.

These equations have been verified experimentally in the referenced article so are useful to show general properties and in preliminary design. FIG. 1 compares the McKibben muscle during pressurization and depressurization. Note that the lines drawn within the muscle body represent fibers of the expandable sleeve which constrain the shape of the muscle during pressurization. Pressurization port 1 allows pneumatic inflation of a bladder contained within the muscle unit 2. The bladder unit is constrained by a biaxial braid expandable sleeve made of a flexible but inextensible material like nylon with an acute fiber angle during depressurization (about 28 degrees relative to the long axis) and larger angle (about 54 degrees relative to the long axis) during maximum pressurization. If the muscle is wrapped around an elastic body part, the body part will be compressed by a combined circumferentially applied tension (belt tightening condition) and pressure. In the depressurized state, the muscle bladder can be completely emptied and can then lie flattened (belt loosening condition) against a surface.

Figure 2:
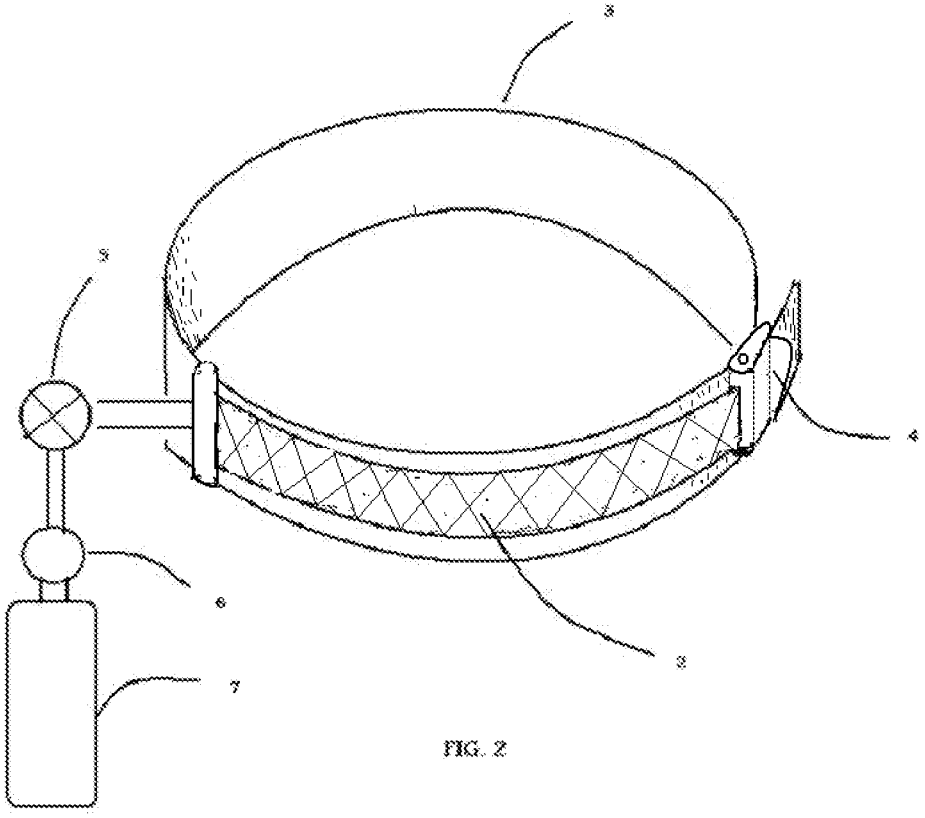
FIG. 2. Artificial muscle mounted on a belt to be placed around a body part.
Figure 3:
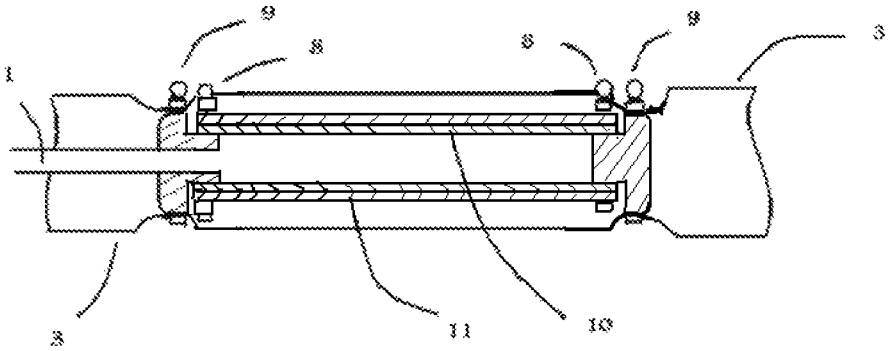
FIG. 3. Details of clamping artificial muscle to belt.

FIG. 2 Shows a single McKibben muscle mounted on a belt in the depressurized or flattened state. The ends of the muscle are firmly attached to the belt 3 which is adjusted around a body part such as the thorax of a subject for CPR purposes with belt buckle 4. Adjustable fastening of the belt can also be accomplished using hook and loop fastening rather than a belt buckle similar to what is commonly used in back support belts used during lifting heavy objects. Solenoid valve 5 allows electronic control of the cyclical pressurization and depressurization required for CPR purposes. Solenoid valve 5 is of the type which has a vent port which can be connected to the atmosphere or vacuum during depressurization. Vacuum depressurization may be necessary at high CPR cycling rates. Solenoid valve 5 will be selected with an orifice size to match dynamic force transients consistent with known skeletal muscle capabilities (approximately first order contraction and relaxation dynamics of the order of 100 milliseconds). Pressure regulator 6 allows adjustment of the pneumatic pressure applied and the total force dictated by this pressure. The depth of CPR compressions can then be adjusted by regulator 6. Regulator 6 is in turn connected to a pressure source 7. Pressure source 7 can be a previously filled high pressure cylinder of air, oxygen, or any gas safe to be released in the vicinity of the CPR subject. Pressure source 7 can also be an air compressor with sufficient flow capacity or an air or oxygen gas line such as is usually available in hospitals. The muscle consists of a cylindrical inflatable bladder made like an inner tube of a bicycle out of natural latex rubber, artificial butyl rubber, silicone tubing or similar material. The braided outer sleeve is available as expandable biaxial braided sleeving used primarily for wire and cable covering. It should be made of nylon or similar strength material to withstand total forces of the order of 50 lbs for a single sleeve of nominal diameter ¾inch as one example of a specific embodiment for CPR (2 belt systems required for 100 lbs). Different diameters for this sleeve can also be used. Larger diameters are advantageous for even compression of the body surface, but involve a larger inflation volume which takes longer to inflate and makes it more difficult to meet the objective of 100 millisecond response time. Thus, diameter choice represents a compromise between these conflicting design objectives. A cylindrical muscle shape is the preferred embodiment which can be fixed to a belt using circular clamps as shown in FIG. 3. Clamp 8 is used to fasten the bladder and sleeving to the muscle ends. Clamp 9 is used to fasten the muscle ends to the belt which is circumferentially placed around the body part such as the thorax. Since the dorsal surface of the thorax is essentially incompressible, the belt is positioned over the dorsal surface and the muscle over the anterior and lateral surfaces of the thorax for maximum compression. The belt 3 is chosen to be resistant to stretching but easily collapsed when belt tension is reduced. A nylon or similar material belt such as used in safety seat belts, tool belts, or diving weight belts represent the best choice. The belt buckle 4 is of the quick release easily adjustable type commonly used in airline safety seat belts and diving weight belts. Pneumatic pressurization of the McKibben muscle leads to muscle shortening, relaxation of the portion of the belt below the muscle, compression of the body part by a combined action of circumferential tension (tightening of the remaining belt section placed around the body part) and pressure. The belt segment located below the McKibben muscle unit from a purely functional standpoint could also be eliminated since the muscle unit can sustain tension even in the relaxed state although with different elastic properties compared to the belt. Thus, repeated belt tightening and relaxing refers to the belt segment positioned over the dorsal thorax for CPR rather than the segment below the muscle unit. For this application the dorsal thoracic surface is the body part not intended to be compressed. Repeated or prolonged use of the muscle units could lead to stretching and require re-adjustment of the depressurized length of the muscle unit which would then be simpler if the belt segment below the muscle unit were eliminated. However, the preferred alternative would be to replace the belt/muscle units after a single use or after continuous use over a maximum time period on a given subject rather than eliminate this section of the belt. Use of an intact or continuous belt would facilitate rapid initial placement and insure that the muscle unit is not accidentally twisted with resultant deteriorated performance. There are then two independent ways for the McKibben artificial muscle to provide compression of a body part. First, since the artificial muscle is wrapped around the body part any shortening of the muscle will lead to compression as already discussed. Second, when a McKibben muscle is pressurized it assumes a substantially cylindrical shape which then also leads to a net reduction in encircling belt diameter in the transition from a flat to cylindrical shape. A cylindrical diameter of 1 inch for the inflated muscle can then provide up to 0.5 inch in compression depth. This will add to the compression due to artificial muscle shortening to result in 2 inches of net anterior-posterior compression. This second form of compression resembles the action of simple inflatable bladders constrained within encircling bands such as used for the familiar non-invasive blood pressure measurement. Thus, the main novel feature of the present invention is the addition of the belt shortening mode. According to the above estimation based on assumed cylindrical tubes the shortening mode is three times as effective as pure simple pressurization. Simple inflatable bladders can only apply external pressure within an encircling band or belt but cannot shorten the encircling band or belt. Both simple bladders and the artificial muscle used in combination with an encircling belt can result in "tightening" of the belt defined as an increase in belt tension. However, the encircling belt shortens when an artificial muscle is used as described above while use of a simple bladder alone cannot shorten the encircling belt. This difference leads to improved pneumatic efficiency when the artificial muscle is used.

Figure 4:
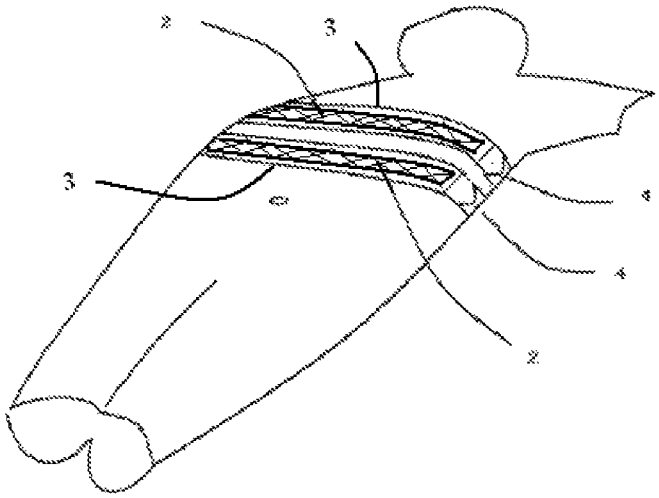
FIG. 4. Two parallel artificial muscle/belt units mounted for CPR use.
Figure 5:
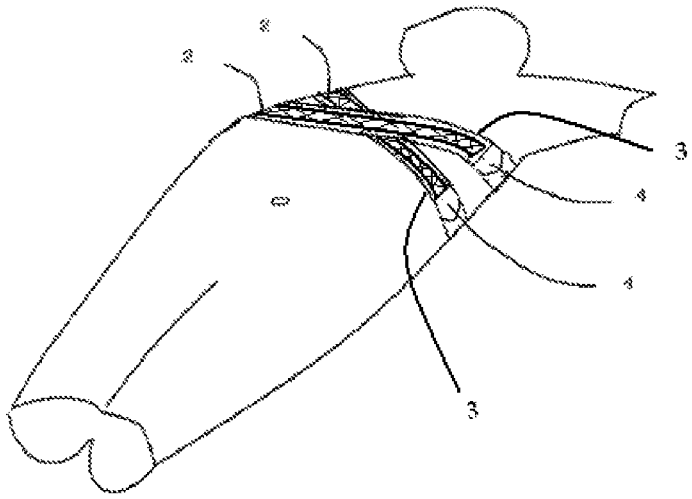
FIG. 5. Two crossing artificial muscle/belt units mounted for CPR use.

FIG. 4 shows the use of two muscle unit/belt units in parallel for CPR. While a single unit can be configured to apply the necessary force for effective CPR, the use of two or more units in parallel promotes a more even distribution of forces. Two units in parallel is the preferred embodiment. FIG. 5 shows the use of two muscle/belt units in a crossing arrangement over the anterior thoracic surface. This crossing arrangement could be advantageous in female or obese subjects to minimize soft tissue trauma. Crossing can be accomplished simply by placing one muscle/belt unit over the other or a special (non-inflating) crossing piece could be used to avoid interference of crossing muscle units. Such interference would result in some amount of unequal force application. A rationale for an advantage for unequal forces is due to the fact that the heart is not located directly below the sternum. About ⅔ of the heart mass is located to the left (of the subject) of the midsternal line with the heart apex (bottom tip) pointing to the left just above the diaphragm. Thus, in a crossing arrangement placing the right to left (top to bottom) muscle/belt unit over the heart location just above the diaphragm below the other left to right muscle/belt unit should maximize direct cardiac compression and is the preferred embodiment. Not specifically shown in FIG. 1 and FIG. 2 are attachments to the belts required to maintain their relative positions. These attachments consist of semi-flexible material such as leather or canvas sewn, riveted, or connected by adjustable hook and loop fastening to the belts. Similarly, activation of solenoid valves (one valve per muscle unit/belt for fastest response) for CPR at 60-100 cycles/min(repeated belt tightening and loosening) with close to a 50-50 pressurization/depressurization cycle requires timing electronics. An astable oscillator can be constructed for this purpose using what is commonly referred to as a "555" timer electronic chip with resistors and capacitances selected to obtain a frequency of 60-100 cycles/min. The output of this circuit can then control a solid state relay to operate the solenoid valves.

Note that while the inventive device involves a tension produced on a belt this tension is produced along with a uniform shortening of the muscle unit in contact with the anterior and lateral thorax surfaces. Also, as mentioned above artificial muscle force decreases proportionally with shortening which in turn reduces mechanical stress on the body surface. This is very different than pulling an inextensible belt across the corner of the anterior and lateral surface of the thorax which leads to chafing, surface burns, and stress concentrations which cause bulging of the lateral thoracic surfaces. Conventional CPR and machines which focus force on a small area of the sternum will involve even more stress concentration and also bulging of lateral thoracic surfaces. No chafing and very even chest compression is promoted by the current device. The likelihood of rib fractures is then reduced significantly.

Figure 6:
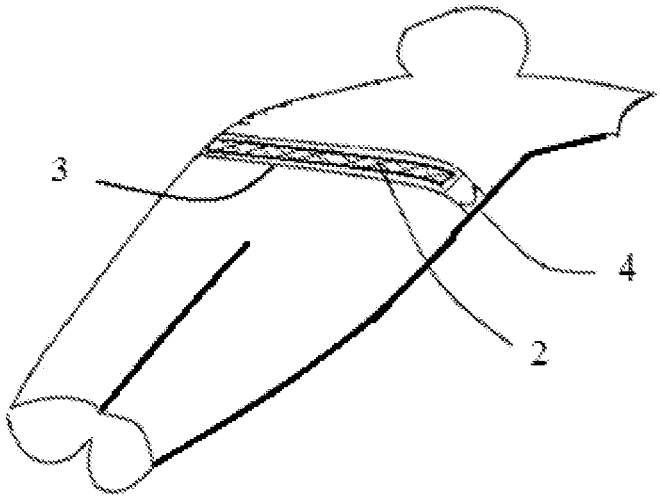
FIG. 6. Artificial muscle/belt unit mounted on the abdomen.

As mentioned in the background section cyclical abdominal compression can be used for CPR purposes. It is not currently recommended except as a last resort when a chest injury prevents normal CPR to be used. The inventive device can just as effectively compress the abdomen as the chest simply by placing the muscle unit/belt units over the abdomen. FIG. 6 shows a subject with a muscle unit/belt placed over the abdomen. A natural placement would be along the transversus abdominis muscles whose fibers compress the abdominal contents along a horizontal (perpendicular to the spine) direction below the ribs. Similar to physiological rib cage compression, the abdominal muscles uniformly compress the abdominal contents. Use of the inventive device leads to a similar uniform compression condition with the belt portion positioned over the posterior (back) abdominal surface corresponding to the body part not to be compressed and subjected to repeated tightening and loosening due to pressurization and depressurization. Lower total force can be applied compared to the chest since the abdomen is more elastic compared to the chest due to the absence of ribs. The thorax could also be simultaneously or alternately cyclically compressed using the configuration of FIG. 4 or FIG. 5 along with the abdominal compression shown in FIG. 6. Another possible combination is to use cyclical chest compression and a constant abdominal compression.

Effective cough assist flows have been reported when a deep inspiration is followed by a combined manually applied anterior chest compression and abdominal compression or thrust (J. R. Bach Eur. Respir. Rev. 3: 284-291, 1993). This procedure requires voluntary subject co-operation since it involves voluntary closure of the glottis to maximize driving pressure for cough followed by transient opening to maximize expired airflow. Anterior and lateral chest compression can be accomplished in the same manner as described above for CPR as in FIG. 4 or FIG. 5 using the inventive device. Abdominal compression can be similarly applied for cough assist as shown in FIG. 6 simultaneously with chest compression or applied alone by placing a similar artificial muscle/belt unit over the abdomen. Limiting the compression to the lower abdomen (below the stomach) can minimize complications presented by direct compression of a full stomach. These assistive compressions would be under patient control to allow synchronization of assist with the patient glottis state. The solenoid valve 5 can be activated by an electrical switch or push button. Since a normal cough is of short duration, switch or button activation by the subject will trigger an electronic timer circuit which limits the time of pressure application to one or two seconds. This manner of electronic control is commonly used by those skilled in the art. Solenoid valve 5 would be selected with an orifice size large enough to allow bladder inflation to occur within 100 milliseconds. Chest and/or abdominal compression can be also done simultaneously with the prior art in-exsufflator machine (Be'eri, U.S. Pat. No. 7,096,866) to further enhance assisted cough airflow.

Abdominal compression as shown in FIG. 6 using the inventive device for use such as enhancement of the Valsalva maneuver for assist of defecation or bladder emptying or as a diagnostic test of cardiovascular function or altitude pressure equalization can be accomplished in a similar way as cough assist except chest compression would not be involved and a lower level of patient adjustable pressure would be applied for a longer time duration (solenoid valve switched on and off by the patient).

Figure 7:
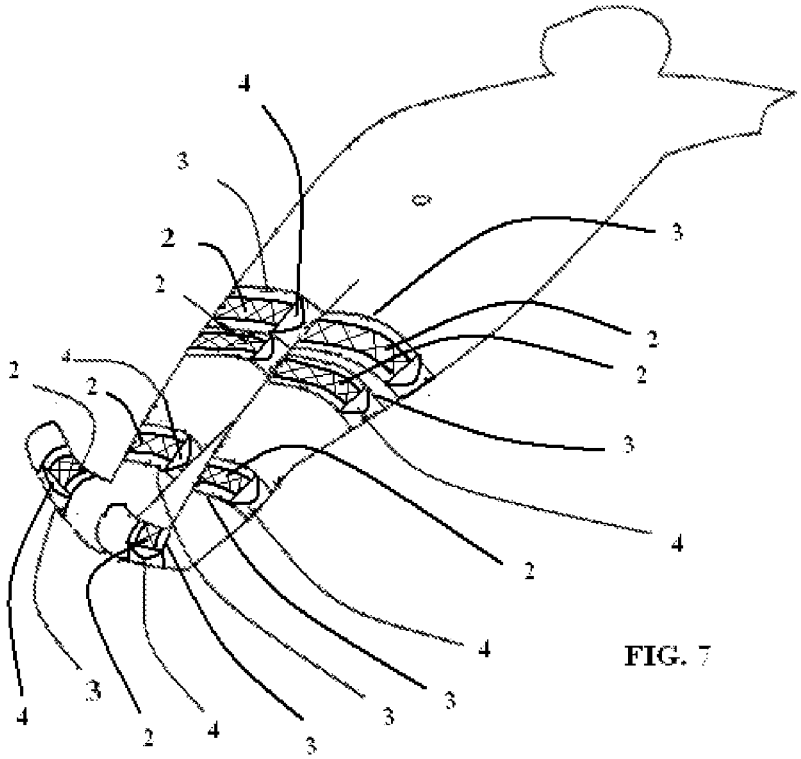
FIG. 7. Artificial muscle/belt units mounted on the legs.

Compression of the limbs such as the thigh, calf, foot can also be accomplished by the present inventive device as shown in FIG. 7 as therapy for deep vein thrombosis to promote blood return to the heart. Multiple artificial muscle/belt units arranged as shown in FIG. 2 can be used. The belt section to be placed over the portion of the leg not to be compressed corresponds to areas which contain the least amount of muscle and therefore least effective for compression for the purpose of blood return to the heart. This belt section would undergo tightening and loosening due to pneumatic pressurization and depressurization. These areas are the top of the foot, and anterior surfaces of the thigh and calf. FIG. 7 is shown with two artificial muscle/belt units for the thigh, calf, and foot. Each artificial muscle/belt unit requires a pneumatic connection for pressurization. Compression can be done synchronously using solenoid valves controlled as described above for chest/abdomen compression or sequentially as proposed in the prior art using solenoid valves sequentially activated using the same or different pressure levels. It is expected that fewer solenoid valves might be needed than one solenoid valve per artificial muscle/belt unit due to the smaller volumes associated with this type of assist. Note that compression or actually belt shortening is set according to a pressure level within the artificial muscle bladder, but this is very different than an inflation pressure of a bladder surrounding the leg. A bladder surrounding the leg will impose a constant force on the leg surface determined by the bladder pressure and contact area on the leg. The artificial muscle has a sleeve which limits surface pressure due to inextensible fibers. Thus, belt tension rather than bladder pressure mainly determines compression of the leg. Tension T is proportional to net compressive pressure P according to the Laplace relationship for a cylindrically applied belt (Thomas, European Wound Management Assoc. Journal 3: 21-23, 2003):

$$P\ (\text{Pascals}) = T\ (\text{newtons}) * n / (\text{radius (meters)} * \text{width of belt (meters)})$$

where n=number of muscle units in parallel.

This formula was actually derived for a bandage placed over a wound, but it involves the same forces as a tensioned belt over a body part. Tension decreases as limb volume decreases due to blood movement due to the artificial muscle length-tension property. Pressure will also decrease because Tension T decreases more than radius according to the McKibben muscle property. For example, a change in muscle length from 23 to 15 inches can lead to tension change from maximum to 0 tension. If the muscle is circumferentially arranged radius would change from 3.7 to 2.4 inches. A muscle diameter increase during shortening (due to constant muscle cell volume) will also lead to compression of adjacent veins which leads to blood return to the heart. Similarly, bladder inflation and increased diameter of the artificial muscle will assist compression of leg veins. Artificial muscle tension and bladder volume contribute to limb compression in an additive way with tension having the dominant role. Since maximum tension occurs at the initial maximum length, a high initial compressive pressure is promoted and resultant high flow from the limb back to the heart. As limb volume is reduced due to limb blood volume reduction tension reduces proportionally. Ultimately tension is reduced sufficiently to lower the steady state pressurization level to be just adequate for near maximum blood volume reduction (about 22.5 mm Hg). The steady state pressurization level is adjusted by a regulator which sets applied pressure. In this way a high initial peak flow is promoted from the limb muscles while minimizing the steady pressure level during pressurization. To mimic natural muscle action, solenoid orifice resistance will be chosen to have a net response time of about 100 msec. Total time of inflation will be set by an electronic timing circuit such as mentioned previously controlling solenoids to about one second with inflations repeated about every 20 seconds in accordance with currently accepted practice for intermittent compression devices. The inventive device then promotes a high initial pressure and peak flow during transient pressurization and subsequent reduction in pressure according to a length-tension property similar to natural muscle which then minimizes surface trauma. Up to a six fold reduction in steady state pressurization levels is then possible (22.5 mm Hg compared to 130 mm Hg).

Figure 8:
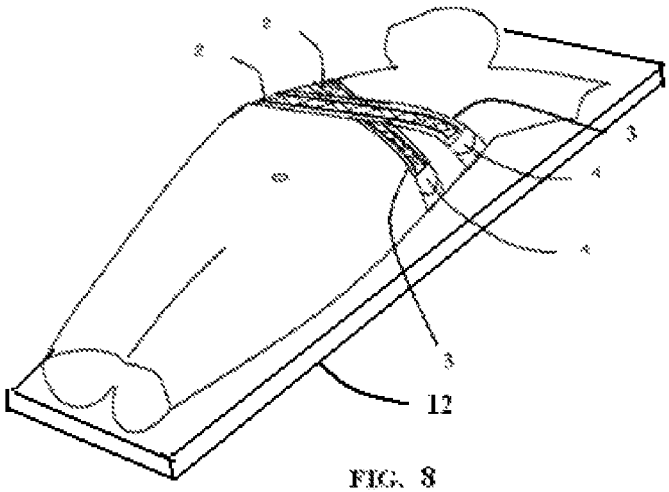
FIG. 8. Artificial muscle/belt units also attached to a fixed surface.

Many embodiments of body surface compression devices using a pneumatic shortening element for medical purposes have been described above. Rather than attachment using only belts, the artificial muscle could also be additionally connected to a substantially fixed surface 12 as shown in FIG. 8 upon which a body part is placed. By including several examples of how the inventive device can be used for different applications the advantages of incorporating a natural muscle-like length-tension property using artificial muscle becomes clearer from a teaching standpoint because the unresolved problems facing the prior art are different. While the preferred embodiments of the devices have been described as what is presently considered to be the most practical, they are merely illustrative of the principles of the inventions. Other embodiments and configurations may be devised without departing from the spirit of the inventions and the scope of the appended claims.

We claim:

1. A device for compressing a portion of a body part of a patient comprising: a belt or plurality of belts adapted to extend around the body part; said belt or each of said plurality of belts with a pneumatic artificial muscle means for shortening also adapted to be fastened directly the belt or plurality of belts such that the pneumatic artificial muscle means for shortening is operably connected in parallel to said belt or plurality of belts for repeatedly tightening and relaxing said belt or plurality of belts around said body part of a patient by alternating pressurization and de-pressurization of the said pneumatic artificial muscle means for shortening, said pneumatic artificial muscle means for shortening adapted to directly compress the portion of said body part said artificial muscle means for shortening is fastened over as well as simultaneously decreasing the length extending between belt fastening points during said pressurization; said belt or plurality of belts is able to substantially resist stretch but not compressive forces; the portion of said belt or plurality of belts undergoing said tightening during said pressurization adapted to be placed over the portion of said body part which is not intended to be compressed.

2. The device of claim 1 wherein said belt or plurality of belts partially extends around the body part and is also connected to a fixed surface upon which the portion of said body part which is not intended to be compressed is adapted to be placed.

3. The device of claim 1 wherein said belt or plurality of belts is more than one belt are arranged in parallel fashion to each other wherein said plurality of belts do not overlap over the said body part.

4. The device of claim 2 wherein said belt or plurality of belts is more than one belt are arranged in parallel fashion to each other wherein said plurality of belts do not overlap over the said body part.

5. The device of claim 1 wherein said belt or plurality of belts is more than one belt are arranged in a crossing fashion wherein said plurality of belts overlap over some portion of the said body part intended to be compressed.

6. The device of claim 2 wherein said belt or plurality of belts is more than one belt are arranged in a crossing fashion wherein said plurality of belts overlap over some portion of the said body part intended to be compressed.

7. The device of claim 3 wherein said body part is the thorax and said compressing of the anterior and lateral surfaces are done for cardiopulmonary resuscitation (CPR).

8. The device of claim 4 wherein said body part is the thorax and said compressing of the anterior and lateral surfaces are done for cardiopulmonary resuscitation (CPR).

9. The device of claim 5 wherein said body part is the thorax and said compressing of the anterior and lateral surfaces are done for cardiopulmonary resuscitation (CPR).

10. The device of claim 6 wherein said body part is the thorax and said compressing of the anterior and lateral surfaces are done for cardiopulmonary resuscitation (CPR).

11. The device of claim 1 wherein said body part is the abdomen and said compressing of the anterior and lateral surfaces are done for cough assist.

12. The device of claim 11 wherein an additional said body part is the thorax is simultaneously involve in said compressing of the anterior and lateral surfaces for cough assist.

13. The device of claim 1 wherein said body part is the abdomen and said compressing of the anterior and lateral surfaces are done for assist of the Valsalva maneuver.

14. The device of claim 1 wherein said body part is either or both legs and said compressing of a portion of either or both legs is done for circulatory assist in promoting blood flow from the legs back to the heart.

15. The device of claim 1 wherein said body part is either or both arms and said compressing of a portion of either or both arms is done for circulatory assist in promoting blood flow from the arms back to the heart.

* * * * *